US012672305B2

(12) United States Patent
Yoon

(10) Patent No.: US 12,672,305 B2
(45) Date of Patent: Jun. 30, 2026

(54) FINFET INCLUDING A GATE ELECTRODE HAVING AN IMPURITY REGION AND METHODS OF FORMING THE FINFET

(71) Applicant: SK hynix Inc., Gyeonggi-do (KR)

(72) Inventor: Young Gwang Yoon, Gyeonggi-do (KR)

(73) Assignee: SK hynix Inc., Gyeonggi-do (KR)

( * ) Notice: Subject to any disclaimer, the term of this patent is extended or adjusted under 35 U.S.C. 154(b) by 1200 days.

(21) Appl. No.: 17/579,081

(22) Filed: Jan. 19, 2022

(65) Prior Publication Data

US 2023/0028496 A1 Jan. 26, 2023

(30) Foreign Application Priority Data

Jul. 26, 2021 (KR) ..... 10-2021-0097933

(51) Int. Cl.
*H10D 30/62* (2025.01)

(52) U.S. Cl.
CPC ..... *H10D 30/6211* (2025.01); *H10D 30/6219* (2025.01)

(58) Field of Classification Search
None
See application file for complete search history.

(56) References Cited

U.S. PATENT DOCUMENTS 9,786,788 B1 * 10/2017 Anderson ..... H10D 30/6735
2009/0242990 A1 * 10/2009 Saitoh ..... H10D 84/0193 257/E27.111
2016/0181412 A1 * 6/2016 Kwon ..... H10D 84/83 257/288
2017/0005165 A1 * 1/2017 Chen ..... H10P 50/268

FOREIGN PATENT DOCUMENTS

KR 10-2018-0069698 A 6/2018

* cited by examiner

*Primary Examiner* — Nishath Yasmeen
(74) *Attorney, Agent, or Firm* — IP & T GROUP LLP

(57) ABSTRACT

Embodiments of the present disclosure provide a FinFET. The FinFET may include fin-type active regions protruding from a substrate, the fin-type active regions extending in a first direction, a field insulating layer on a surface of the substrate between the fin-type active regions, and gate structures disposed on surfaces of the fin-type active regions and a surface of the field insulating layer, the gate structures extending in a second direction perpendicular to the first direction. Each of the gate structures may include a gate dielectric layer conformally disposed on the surfaces of the fin-type regions and a gate electrode on the gate dielectric layer. The gate electrode may include low concentration impurity regions close to the field insulating layer, and high concentration impurity regions close to an upper portion of the fin-type active regions.

17 Claims, 22 Drawing Sheets

FINFET INCLUDING A GATE ELECTRODE HAVING AN IMPURITY REGION AND METHODS OF FORMING THE FINFET

CROSS-REFERENCE TO RELATED APPLICATIONS

The present application claims priority to Korean Patent Application No. 10-2021-0097933, filed on Jul. 26, 2021, which is herein incorporated by reference in its entirety.

BACKGROUND

1. Field

The present disclosure relates to a Fin Field Effect Transistor (FinFET) including a gate electrode having an impurity region, and a method of forming the same.

2. Description of the Related Art

A FinFET with improved current driving capability of the gate electrode has been proposed.

SUMMARY

Embodiments of the present disclosure provide a FinFET including a gate electrode having an impurity region.

Embodiments of the present disclosure provide a method of forming a FinFET including a gate electrode having an impurity region.

According to an embodiment of the present disclosure, a FinFET may include fin-type active regions protruding from a substrate, the fin-type active regions extending in a first direction, a field insulating layer on a surface of the substrate between the fin-type active regions, and gate structures disposed on surfaces of the fin-type active regions and a surface of the field insulating layer, the gate structures extending in a second direction perpendicular to the first direction. Each of the gate structures may include a gate dielectric layer conformally disposed on the surfaces of the fin-type regions and a gate electrode on the gate dielectric layer. The gate electrode may include low concentration impurity regions close to the field insulating layer, and high concentration impurity regions close to an upper portion of the fin-type active regions.

According to an embodiment of the present disclosure, a FinFET may include fin-type active regions protruding from a surface of a substrate, the fin-type active regions extending in a first direction, a field insulating layer on the surface of the substrate between the fin-type active regions, and gate structures disposed on surfaces of the fin-type active regions and a surface of the field insulating layer, the gate structures extending in a second direction perpendicular to the first direction. Each of the gate structures may include a gate dielectric layer conformally disposed on the surfaces of the fin-type active regions and a gate electrode on the gate dielectric layer. The gate electrode includes amorphization ions and dopant ions. The dopant ions have a concentration profile gradually decreasing from upper portions of the fin-type active regions in a radial direction.

According to an embodiment of the present disclosure a method of forming a FinFET may include forming a fin-type active region on a substrate, forming a gate dielectric layer on top surfaces and side surfaces of the fin-type active regions, forming a first lower gate electrode material layer on the gate dielectric layer, performing a first amorphization process to amorphize a portion of the first lower gate electrode material layer to form a first amorphization region, performing a first dopant implantation process to form a first doped region in the first amorphization region, forming a second lower gate electrode material layer on the first lower gate electrode material layer, performing a second amorphization process to amorphize a portion of the second lower gate electrode material layer to form a second amorphization region, performing a second dopant implantation process to form a second doped region in the second amorphization region, forming an upper gate electrode material layer on the second lower gate electrode material layer, and performing an ion drive-in process to drive the dopants in the first doping region and the second dopant region into the upper gate electrode material layer.

According to an embodiment of the present disclosure, a method of forming a FinFET may include forming fin-type active regions on a substrate, forming a gate dielectric layer on top surfaces and side surfaces of the fin-type active regions, forming a first lower gate electrode material layer on the gate dielectric layer, diagonally implanting first amorphization ions and first dopant ions into an upper region of the first lower gate electrode material layer, forming a second lower gate electrode material layer on the first lower gate electrode material layer, diagonally implanting second amorphization ions and second dopant ions into upper regions of the second lower gate electrode material layer, forming an upper gate electrode material layer on the second lower gate electrode material layer, and diffusing the first dopant ions and the second dopant ions.

According to an embodiment of the present disclosure, a semiconductor device may include a plurality of active regions each extending in a first direction, the plurality of active regions being spaced apart from each other along a second direction and extending vertically above a substrate in a third direction; a field insulating layer disposed on a surface of the substrate between the active regions and surrounding side surfaces of lower portions of the active regions, and a plurality of gate structures disposed on a surface of the active regions and extending in parallel with each other in the second direction. The gate structures include a first impurity region closer to the field insulating layer and a second impurity region closer to an upper portion of the active regions, the first and second impurity regions having different impurity concentrations.

DETAILED DESCRIPTION

Figure 1A:
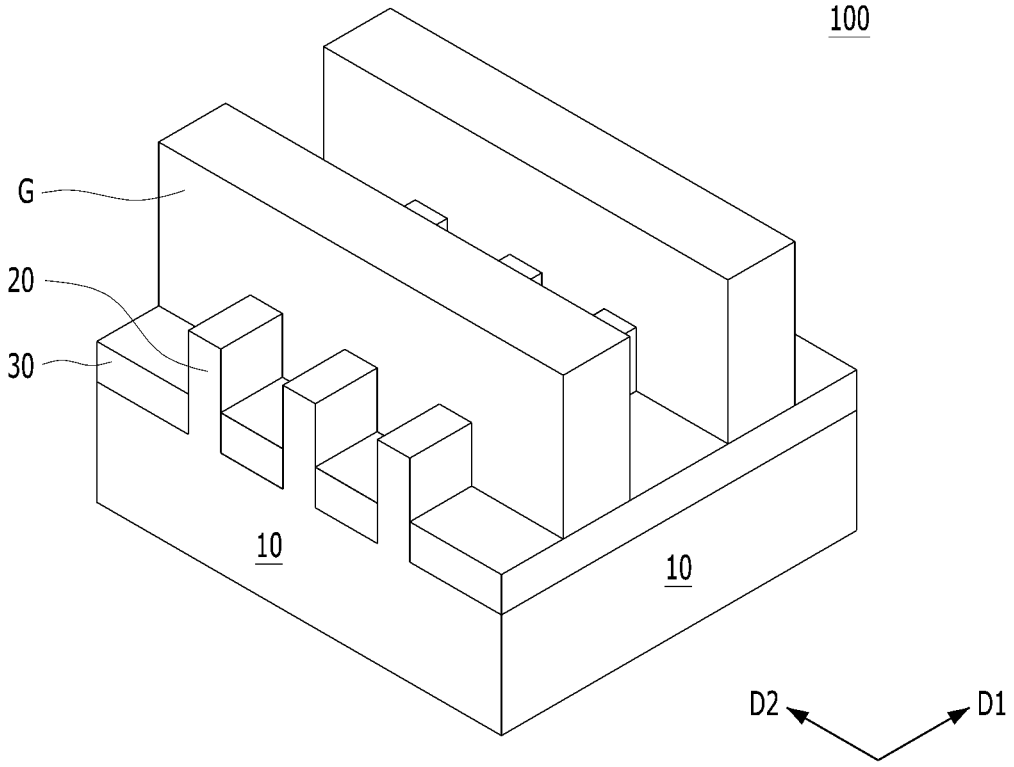
FIGS. 1A and 1B are a perspective view and a layout schematically illustrating a semiconductor device including a FinFET according to an embodiment of the present disclosure.

Various embodiments of the present disclosure will be described below in more detail with reference to the accompanying drawings. The drawings are not necessarily to scale and, in some instances, proportions may have been exaggerated in order to clearly illustrate features of the embodiments. When a multi-layer structure having two or more layers is disclosed in the drawings or detailed description, the relative positional relationship or arrangement order of the layers as shown only reflects a specific embodiment, and thus the present disclosure is not limited thereto. The present disclosure may include different relative positional relationships or arrangement orders from the illustrated embodiments. Furthermore, the drawings or detailed description of a multi-layer structure may not reflect all layers present in a particular multi-layer structure (e.g., one or more additional layers may be present between the two layers shown). For example, when the multilayer structure is illustrated to include a first layer on a second layer or a substrate in the drawings or detailed description, it not only refers to a case where the first layer is formed directly on the second layer or directly on the substrate, but also a case where one or more other layers are present between the first layer and the second layer or between the first layer and the substrate.

Figure 1B:
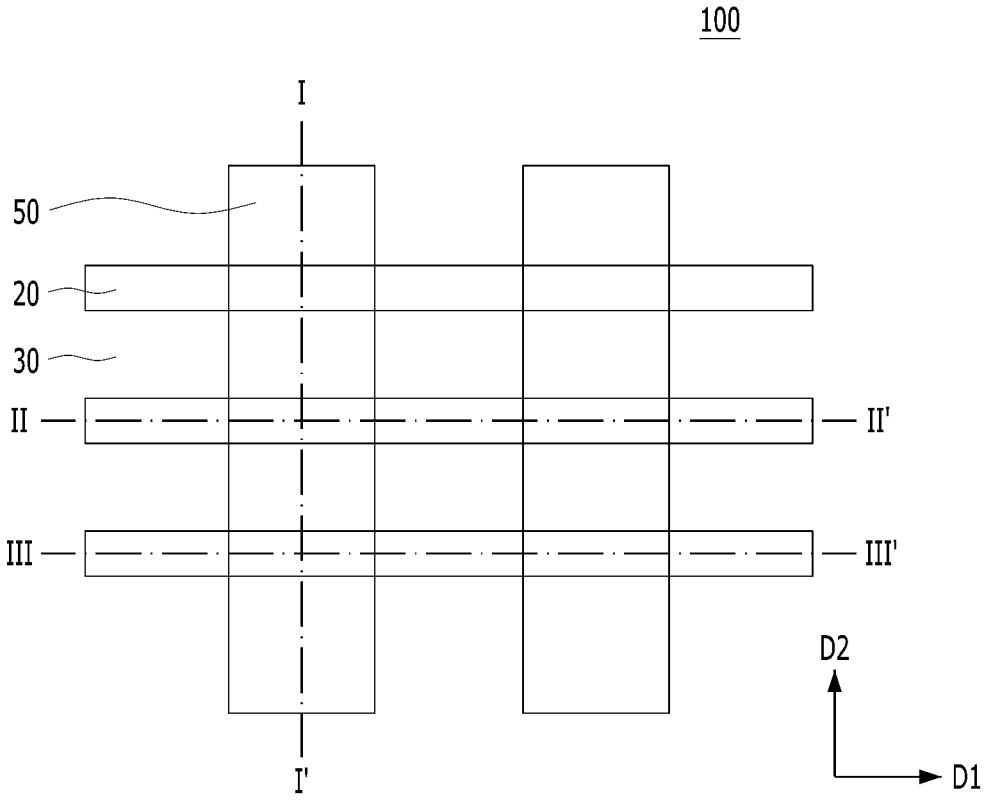

FIGS. 1A and 1B are a perspective view and a layout schematically illustrating a semiconductor device including a FinFET 100 according to an embodiment of the present disclosure.

Referring to FIGS. 1A and 1B, a semiconductor device including a FinFET 100 according to an embodiment of the present disclosure may include fin-type active regions 20 and gate structures G on a substrate. The fin-type active regions 20 may protrude from a surface of the substrate and extend in parallel with each other in a first direction D1. The gate structures G may be disposed on a surface of the fin-type active regions and extend in parallel with each other in a second direction D2. The first direction D1 and the second direction D2 may be perpendicular to each other. Accordingly, the active regions 20 and the gate structures G may cross and intersect each other.

Figure 2A:
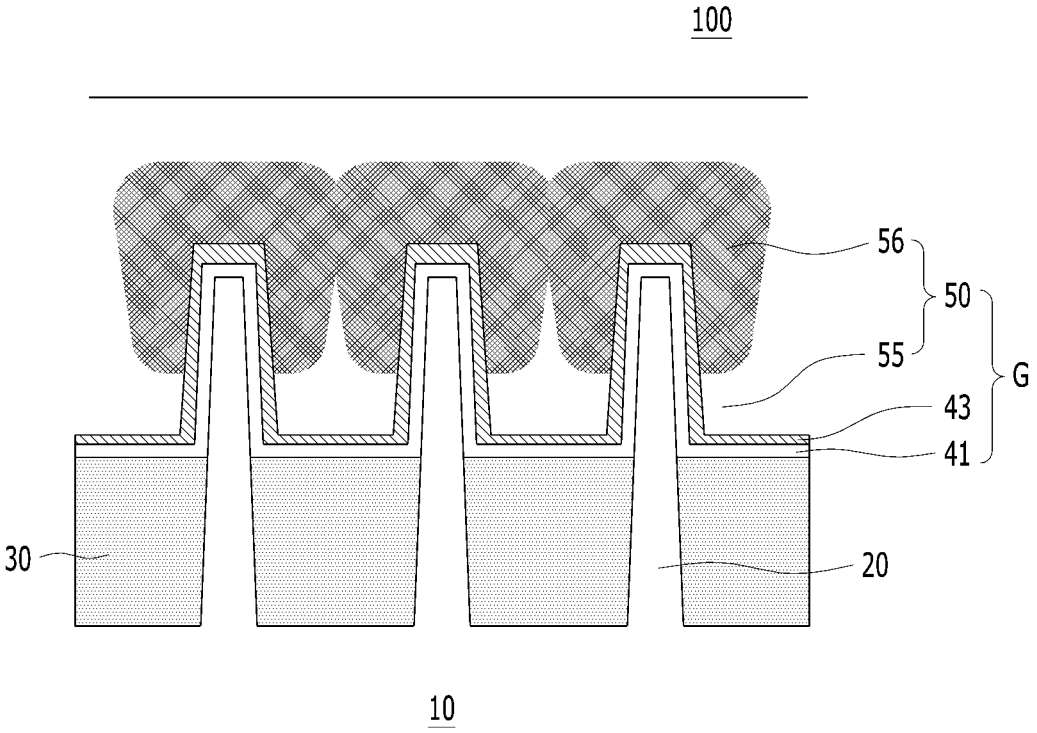
FIGS. 2A to 2C are longitudinal cross-sectional views of the FinFET taken along lines I-I', II-II', and III-III' of FIG. 1B.
Figure 2B:
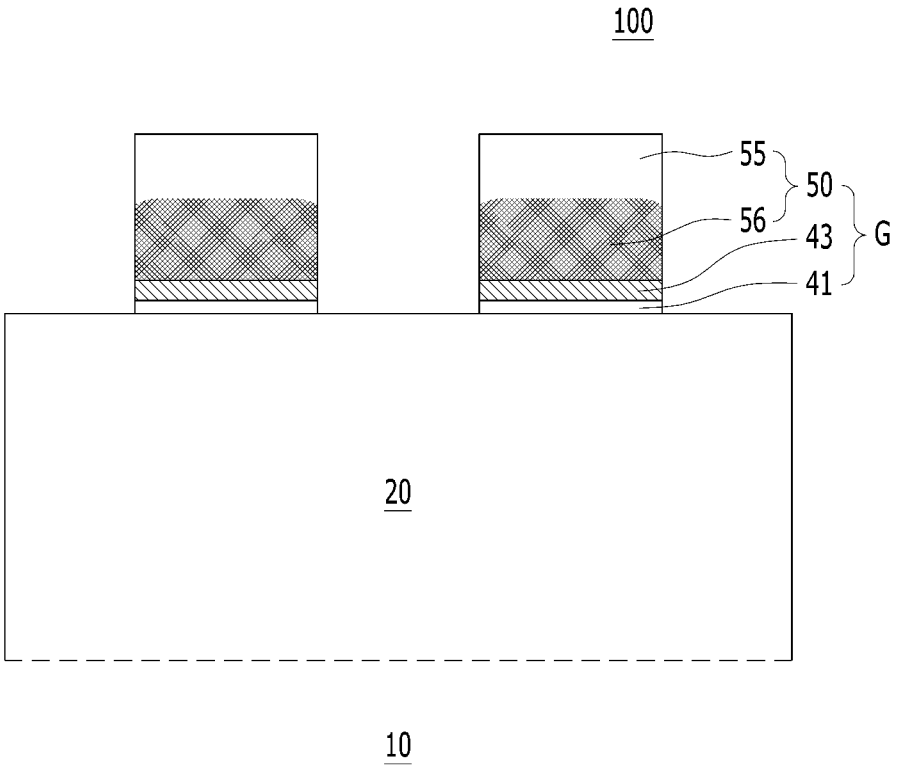
Figure 2C:
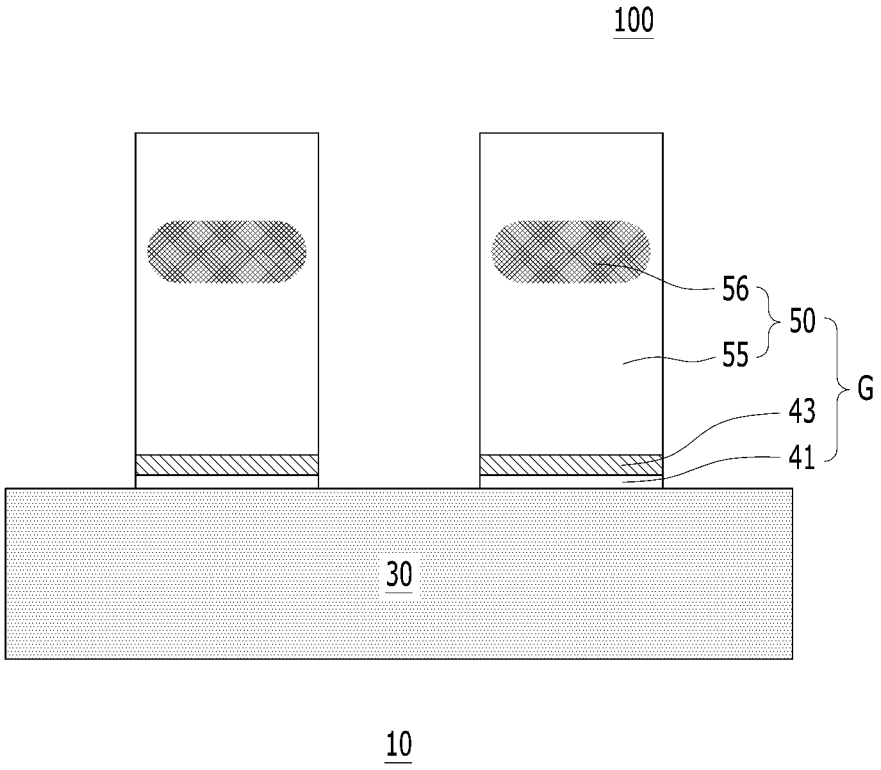

FIGS. 2A to 2C are longitudinal cross-sectional views of the FinFET 100 taken along lines I-I', II-II', and III-III' of FIG. 1B.

Referring to FIGS. 2A to 2C, the FinFET 100 according to embodiments of the present disclosure may include active regions 20, a field insulating layer 30, and a gate structure G on a substrate 10.

The substrate 10 may include, for example, one of a silicon wafer including single crystal silicon, an epitaxially grown silicon layer, or a silicon on insulator (SOI).

The active regions 20 may have a fin shape. For example, the active regions 20 may vertically protrude from a surface of the substrate 10. The active regions 20 may have a dam shape with a larger base than a top surface and tapered side walls.

The field insulating layer 30 may be disposed on the surface of the substrate 10 between the active regions 20. The field insulating layer 30 may surround side surfaces of lower portions of the active regions 20. Accordingly, upper portions of the active regions 20 may protrude from a top surface of the field insulating layer 30 and be exposed. The field insulating layer 30 may electrically insulate the substrate 10 and the gate structure G. The field insulating layer 30 may include, for example, at least one of silicon oxide ($SiO_2$), silicon nitride (SiN), silicon oxynitride (SiON), silicon hydrogen oxide (SiHO), silicon carbon oxide (SiCO), silicon hydrogen carbon oxide (SiHCO), and other insulating materials.

The gate structure G may surround top surfaces and side surfaces of upper portions of the active regions 20. For example, a lower portion of the gate structure G may include recessed portions to surround the active regions 20. The gate structure G may include an interfacial insulating layer 41, a gate dielectric layer 43, and a gate electrode 50. The interfacial insulating layer 41 may be conformally formed directly on the active regions 20. The interfacial insulating layer 41 may include, for example, silicon oxide ($SiO_2$). The gate dielectric layer 43 may be conformally formed on the interfacial insulating layer 41. The gate dielectric layer 43 may include, for example, a high-k dielectric material such as hafnium oxide (HfO). The gate electrode 50 may be formed on the gate dielectric layer 43. The gate electrode 50 may have a flat top surface. The gate electrode 50 may include, for example, polycrystalline silicon. The interfacial insulating layer 41 and the gate dielectric layer 43 of the gate structure G may conformally cover the top surfaces and side surfaces of the active regions 20 which are protruding and exposed.

The gate electrode 50 may include low concentration impurity regions 55 and high concentration impurity regions 56. The low concentration impurity regions 55 may include impurities having a relatively lower concentration than the high concentration impurity regions 56, and the high concentration impurity regions 56 may include impurities having a relatively higher concentration than the lower concentration impurity regions 55. An impurity concentration may be gradually changed between the low concentration impurity regions 55 and the high concentration impurity regions 56. In addition, the impurity concentrations in the low concentration impurity regions 55 and the high concentration impurity regions 56 may be gradually changed, respectively. The impurities may include at least one of amorphization ions and at least one of dopant ions. The amorphization ions may include at least one of nitrogen (N), germanium (Ge), carbon (C), argon (Ar), xenon (Xe), fluorine (F), lanthanum (La), and aluminum (Al). The dopant ions may include at least one of boron (B), phosphorus (P), and arsenic (As).

The high concentration impurity regions 56 may have an upper portion having a relatively wider width than a lower portion. The lower portion may have a relatively narrower width than the upper portion. For example, the high concentration impurity regions 56 may have an impurity distribution of an inverted triangular or inverted trapezoidal shape. In an embodiment, the high concentration impurity regions 56 may have an oval-shaped impurity distribution. In the high concentration impurity regions 56, the impurity concentration may be higher as close to the upper portion of the active regions 20. The center of each of the high concentration impurity regions 56 may be located close to an upper portion of the active regions 20. For example, the high concentration impurity regions 56 may be gradually lowered from the upper portion of the active region 20 in a radial direction. The high concentration impurity regions 56 may be connected to each other.

The low concentration impurity region 55 may be located close to the field insulating layer 30. An impurity concentration in the gate electrode 50 may be lowered as close to the field insulating layer 30. Additionally, the low concentration impurity region 55 may be located close to the top of the gate electrode 50.

FIGS. 3A to 3D are longitudinal cross-sectional views taken along line I-I' of FIG. 1B of FinFETs 100A-100D according to embodiments of the present disclosure.

Figure 3A:
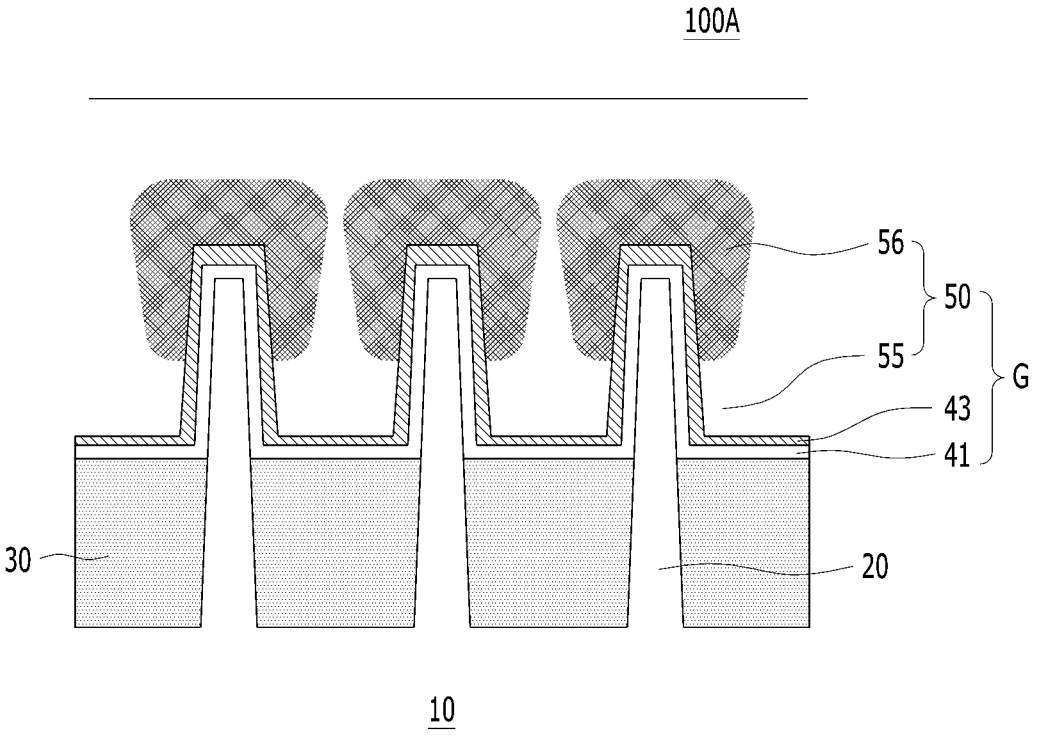
FIGS. 3A to 3D are longitudinal cross-sectional views taken along line I-I' of FIG. 1B of FinFETs according to embodiments of the present disclosure.
Figure 3B:
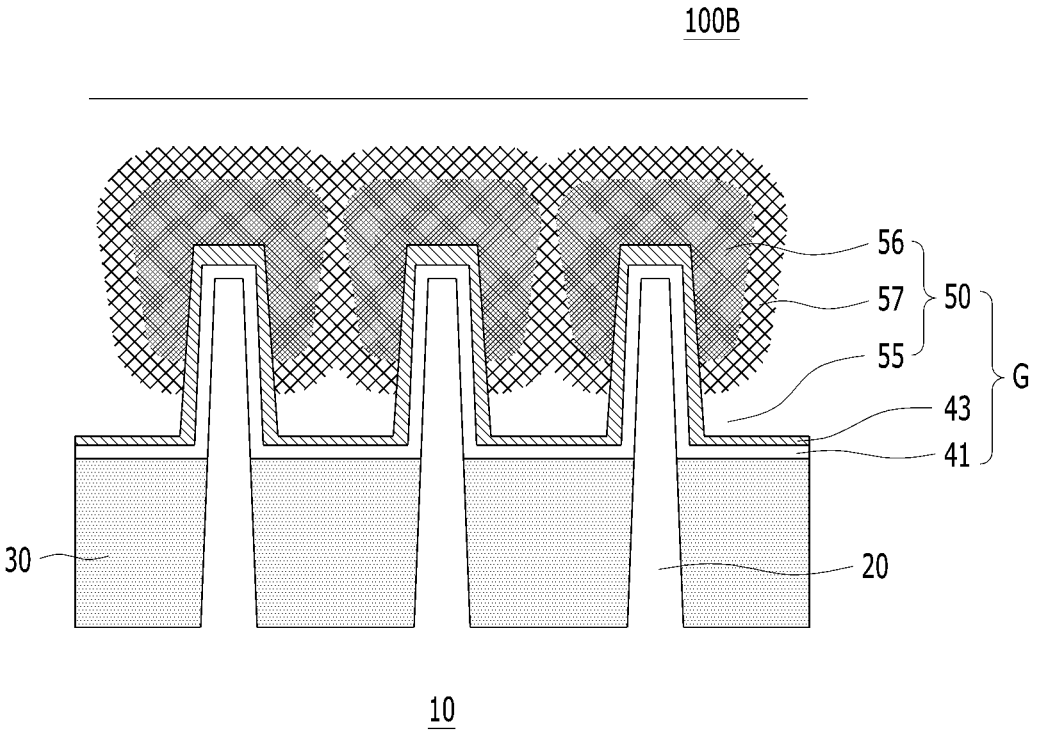
Figure 3C:
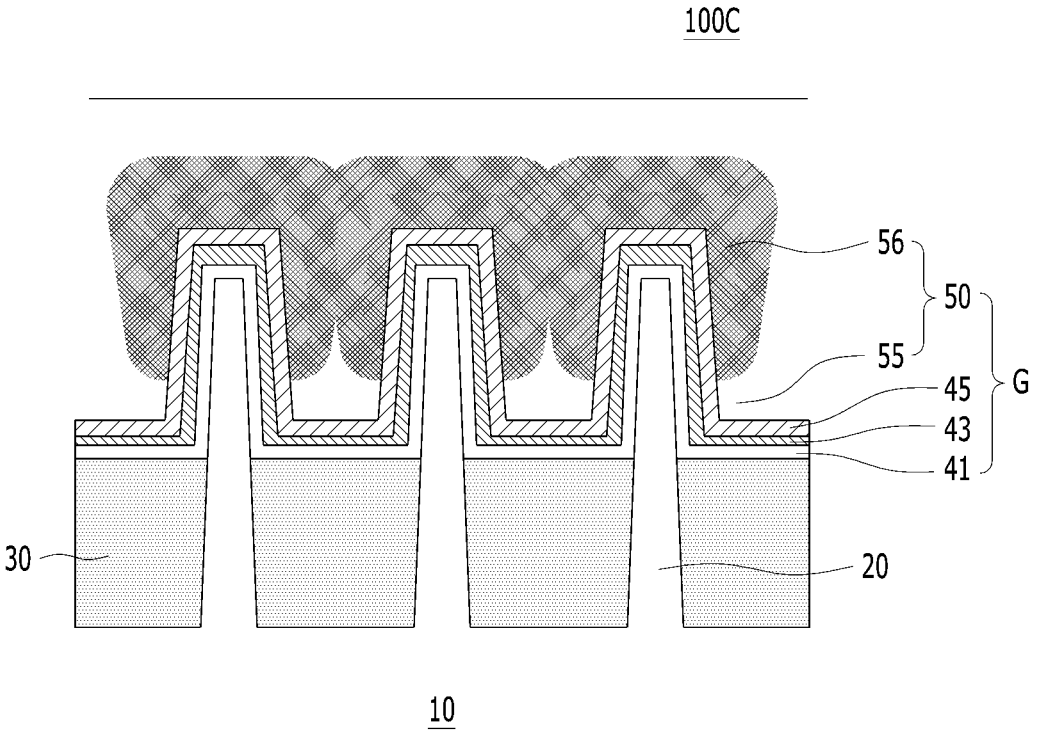
Figure 3D:
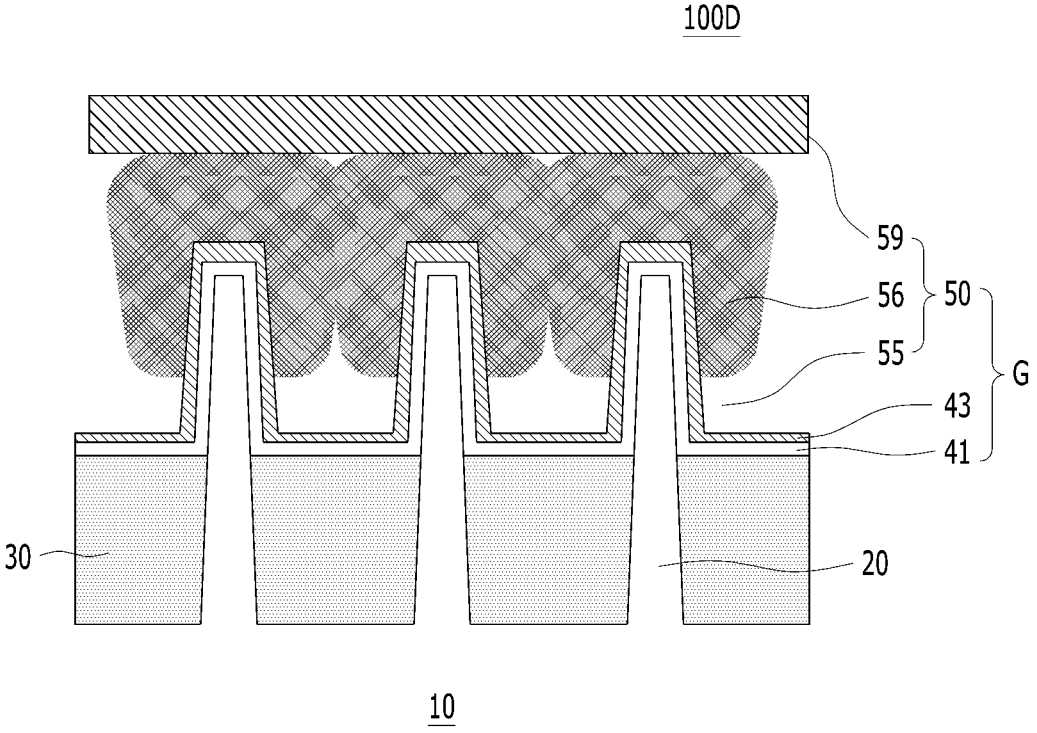

Referring to FIG. 3A, the high concentration impurity regions 56 may be spaced apart from each other. For example, the low concentration impurity regions 55 may be positioned between the high concentration impurity regions 56. Referring to FIG. 3B, the gate electrode 50 may further include intermediate concentration impurity regions 57 between the low concentration impurity regions 55 and the high concentration impurity regions 56. An impurity concentration of the intermediate concentration impurity regions 57 may be greater than an impurity concentration of the low concentration impurity regions 55 and lower than an impurity concentration of the high concentration impurity regions 56. The high concentration impurity regions 56 may be separated and spaced apart from each other, and the intermediate concentration impurity regions 57 may be connected to each other. Impurity concentrations in the low concentration impurity regions 55, the intermediate concentration impurity regions 57, and the high concentration impurity regions 56 may be gradually changed. Referring to FIG. 3C, the gate structure G may further include a barrier layer 45 disposed between the gate dielectric layer 43 and the gate electrode 50. The barrier layer 45 may include a metal compound such as titanium nitride (TiN) or tantalum nitride (TaN). Referring to FIG. 3D, the gate electrode 50 may further include a silicide layer 59 over the high concentration impurity regions 56. The silicide layer 59 may be in contact with the high concentration impurity regions 56. In one embodiment, the silicide layer 59 may be spaced apart from the high concentration impurity regions 56. The technical features of the FinFETs 100 and 100A-100D shown in FIGS. 2A to 2C and 3A to 3D may be interchanged and combined with each other.

FIGS. 4 to 14 illustrate a method of forming a FinFET of a semiconductor device according to an embodiment of the present disclosure.

Figure 4:
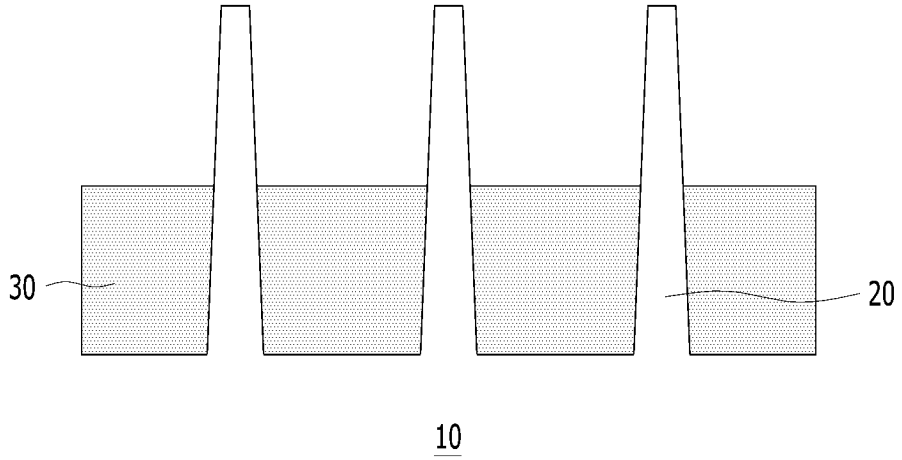
FIGS. 4 to 14 illustrate a method of forming a FinFET of a semiconductor device according to an embodiment of the present disclosure.

Referring to FIG. 4, a method of forming a FinFET of a semiconductor device according to an embodiment of the present disclosure may include forming fin-type active regions 20 on a substrate 10 and forming a field insulating layer 30 on the substrate 10 exposed between the active regions 20. The forming of the active regions 20 may include performing a photolithography process to form a mask pattern (not shown) and performing an etching process using the mask pattern as an etching mask to selectively remove the exposed substrate 10. The forming of the field insulating layer 30 may include forming and recessing an insulating material such as silicon oxide ($SiO_2$). A top surface of the field insulating layer 30 may be positioned at a middle level of the active regions 20.

Figure 5:
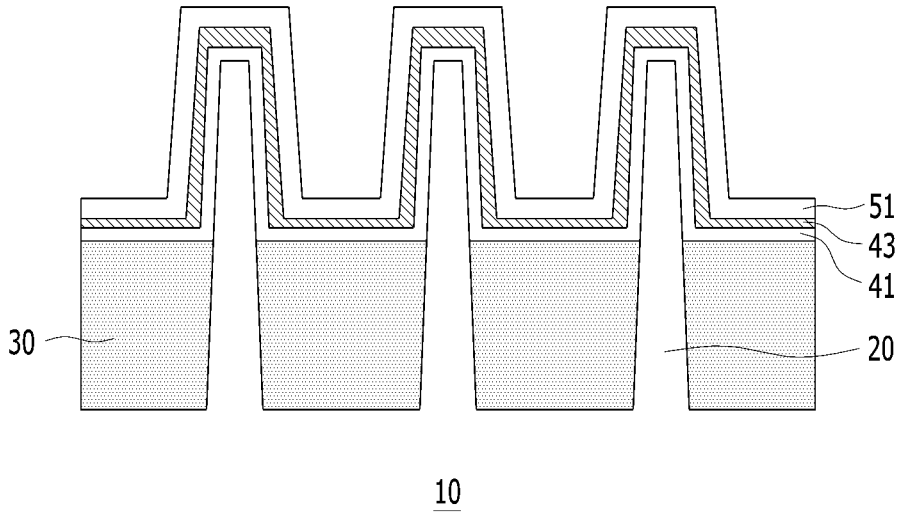

Referring to FIG. 5, the method may further include conformably forming an interfacial insulating layer 41, a gate dielectric layer 43, and a first lower gate electrode material layer 51 on top surfaces and side surfaces of the active regions 20 and a top surface of the exposed field insulating layer 30.

In an embodiment, the forming of the interfacial insulating layer 41 may include performing any one of an atomic layer deposition (ALD) process or a chemical vapor deposition (CVD) process. In an embodiment, the forming of the interfacial insulating layer 41 may include performing an oxidation process to oxidize the exposed surfaces of the active regions 20. The interfacial insulating layer 41 may include, for example, silicon oxide ($SiO_2$). The forming of the gate dielectric layer 43 may include performing any one of an atomic layer deposition (ALD) process or a chemical vapor deposition (CVD) process. The gate dielectric layer 43 may include a high-k material such as hafnium oxide (HfO), zirconium oxide (ZrO), or other metal oxides. The forming of the first lower gate electrode material layer 51 may include performing any one of an atomic layer deposition (ALD) process, a chemical vapor deposition (CVD) process, or a conformal physical vapor deposition (PVD) process. In an embodiment, the first lower gate electrode material layer 51 may include, for example, polycrystalline silicon (poly-Si) or amorphous silicon (a-Si).

Figure 6A:
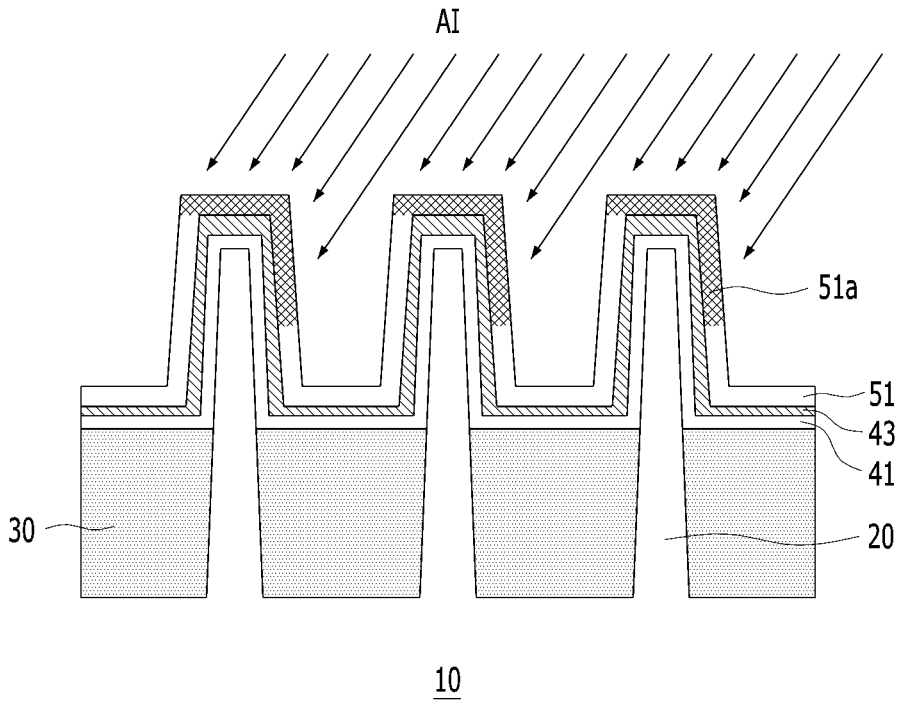
Figure 6B:
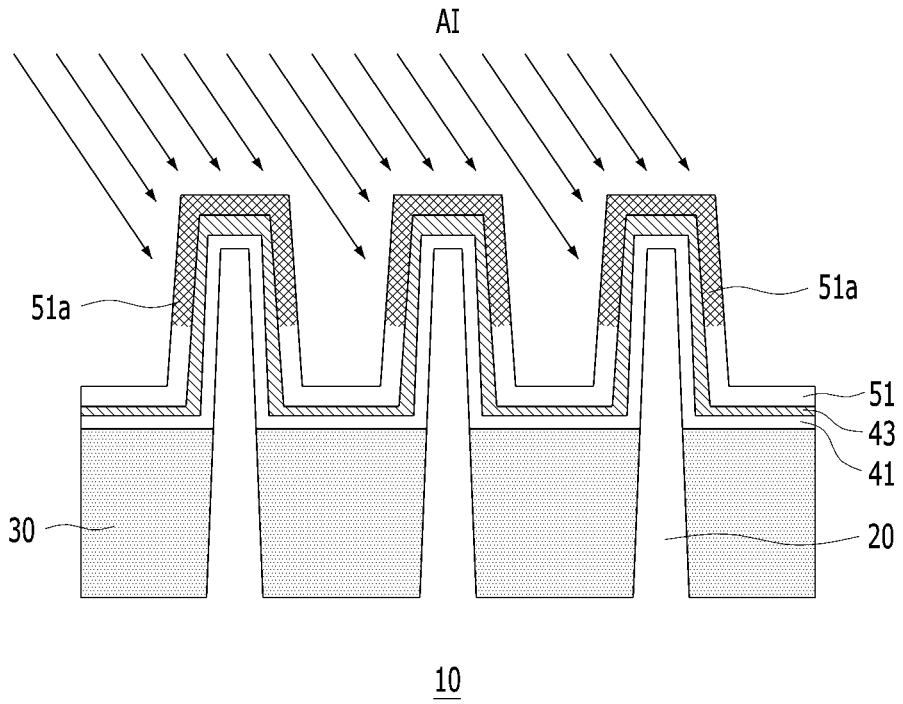
Figure 7A:
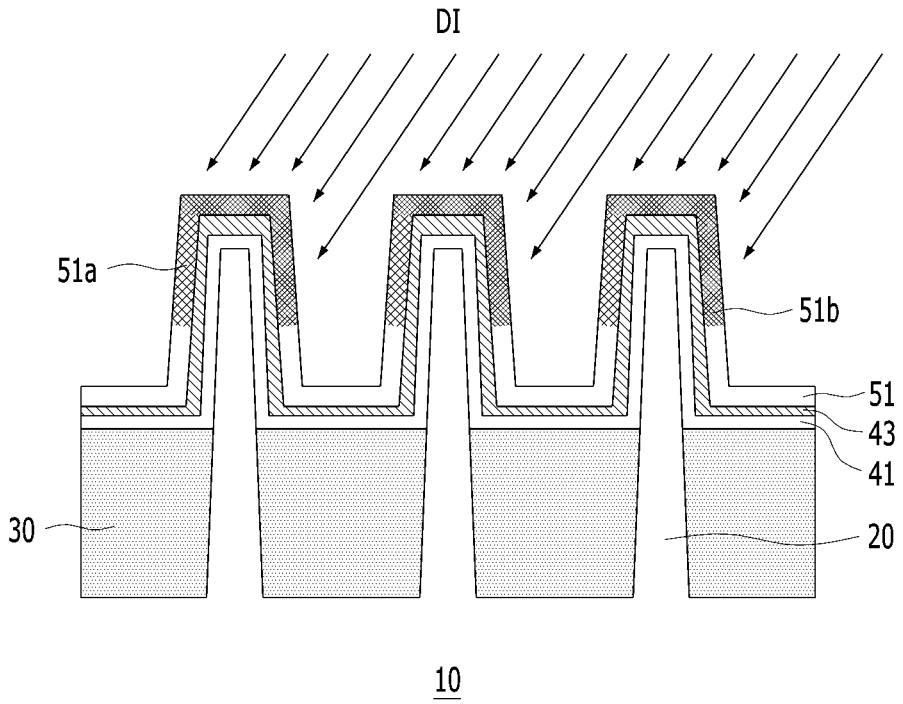
Figure 7B:
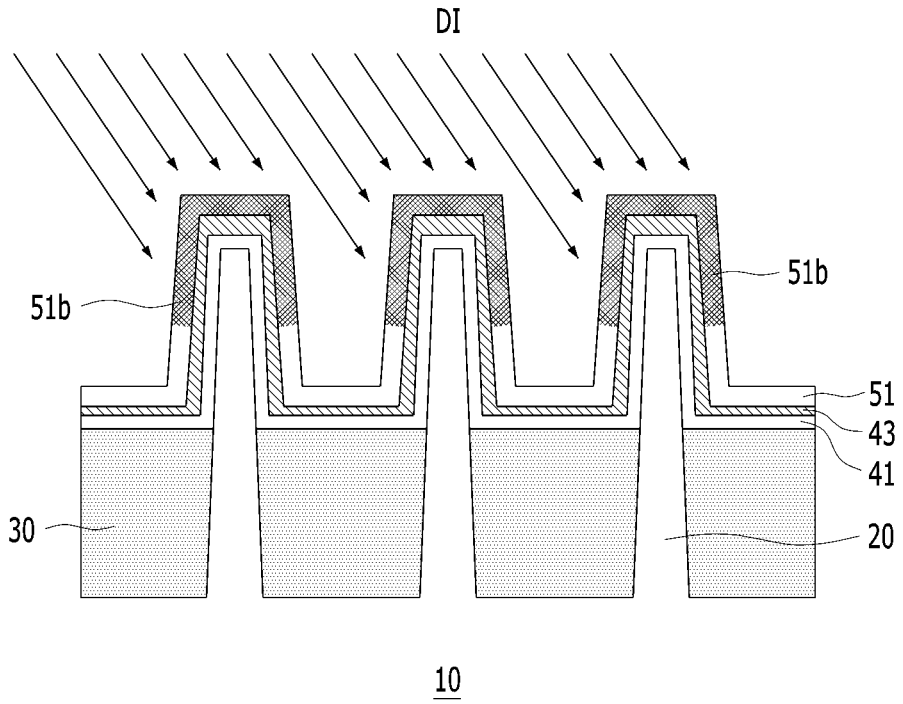

Referring to FIGS. 6A and 6B, the method may further include performing a first amorphization process to partially form first amorphization regions 51*a* in the first lower gate electrode material layer 51. The first amorphization process may include diagonally implanting amorphization ions AI into the first lower gate electrode material layer 51 at an angle with respect to the surface of the substrate 10 to partially amorphize some regions of the first lower gate electrode material layer 51. Accordingly, upper portions and upper portions of side portions of the first lower gate electrode material layer 51 may be amorphized to form the first amorphization regions 51*a*. The amorphization ions AI may not be implanted into lower portions of the first lower gate electrode material layer 51 due to a shadow effect. For example, the implantation angle of the amorphization ions AI may be about from 10° to 60°.

The amorphization ions AI may include ions of nitrogen (N), germanium (Ge), carbon (C), argon (Ar), xenon (Xe), fluorine (F), lanthanum (La), aluminum (Al), or other non-conductive materials. The amorphization ions AI may further amorphize the first lower gate electrode material layer 51. Also, a work function of the first lower gate electrode material layer 51 can be adjusted by implanting the amorphization ions AI. For example, turn-on of the implanted region with the amorphization ions AI can be slower. During operation of the FinFET, since the electric field is concentrated in the upper portion of the fin-type active regions 20, the upper portion of the fin-type active region 20 can be turned on more quickly. In the present disclosure, since the amorphization ions AI implanted close to the upper portion of the fin-type active regions 20 can adjust the work function, the threshold voltage (Vt) of the FinFET can be adjusted.

In one embodiment, the amorphization ions AI may include lanthanum (La) ions or aluminum (Al) ions. When the lanthanum (La) ions or the aluminum (Al) ions are implanted, the conductivity of the first lower gate electrode material layer 51 can be adjusted.

The first amorphization process may include a first right diagonal amorphization process and a first left diagonal amorphization process that are successively performed. In an embodiment, the first amorphization process may include performing a rotational diagonal amorphization process. For example, the first amorphization process may include diagonally implanting the amorphization ions AI into the first lower gate electrode material layer 51 at an angle while rotating the substrate 10.

In addition, the gate dielectric layer 43 may be polarized by implantation of the amorphization ions AI. That is, a threshold voltage can be adjusted.

Referring to 7A and 7B, the method may include performing a first dopant implantation process to form first doped regions 51*b* in the first lower gate electrode material layer 51. The first dopant implantation process may include diagonally implanting the dopant ions DI into the first lower gate electrode material layer 51 at an angle with respect to the surface of the substrate 10 to form the first doped regions 51*b* in partial portions of the gate electrode material layer 51—for example, the first amorphized regions 51*a*. The dopant ions DI may include at least one of boron (B), phosphorus (P), and arsenic (As). The first doped regions 51*b* of the first lower gate electrode material layer 51 may be changed into P-type semiconductor regions or N-type semiconductor regions by the dopant ions DI. For example, the implantation angle of the dopant ions DI may be about from 10° to 60°.

The first dopant implantation process may include a first right diagonal dopant implantation process and a first left diagonal dopant implantation process that are successively performed. In an embodiment, the first dopant implantation process may include performing a rotational diagonal dopant implantation process. For example, the first dopant implantation process may include implanting dopant ions DI into the first lower gate electrode material layer 51 at an angle while rotating the substrate 10. The dopant ions DI may not be implanted into the lower portions of the first lower gate electrode material layer 51 due to a shadow effect.

Figure 8:
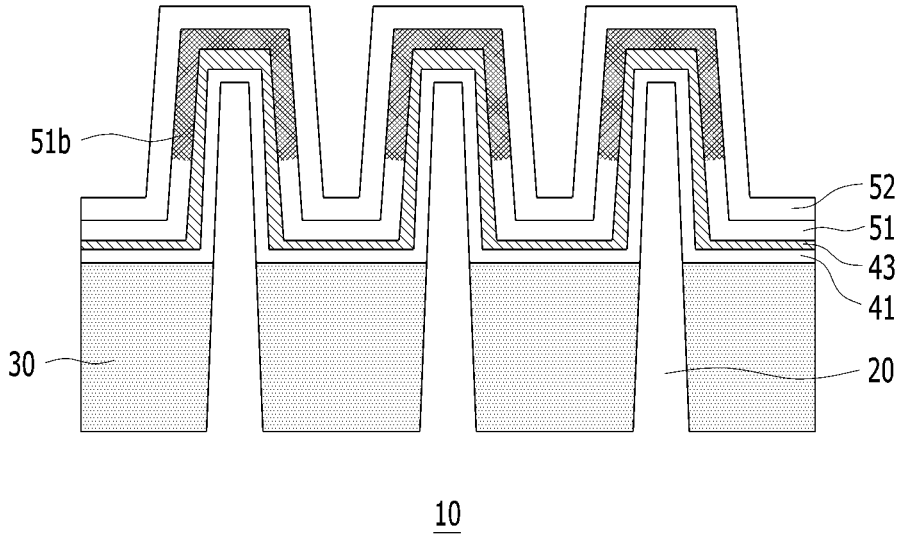

Referring to FIG. 8, the method may include conformally forming a second lower gate electrode material layer 52 on the first lower gate electrode material layer 51. The forming of the second lower gate electrode material layer 52 may include performing one of an atomic layer deposition (ALD) process, a chemical vapor deposition (CVD) process, or a conformal physical vapor deposition (CPVD) process. The second lower gate electrode material layer 52 may include, for example, polycrystalline silicon (poly-Si) or amorphous silicon (a-Si).

Figure 9:
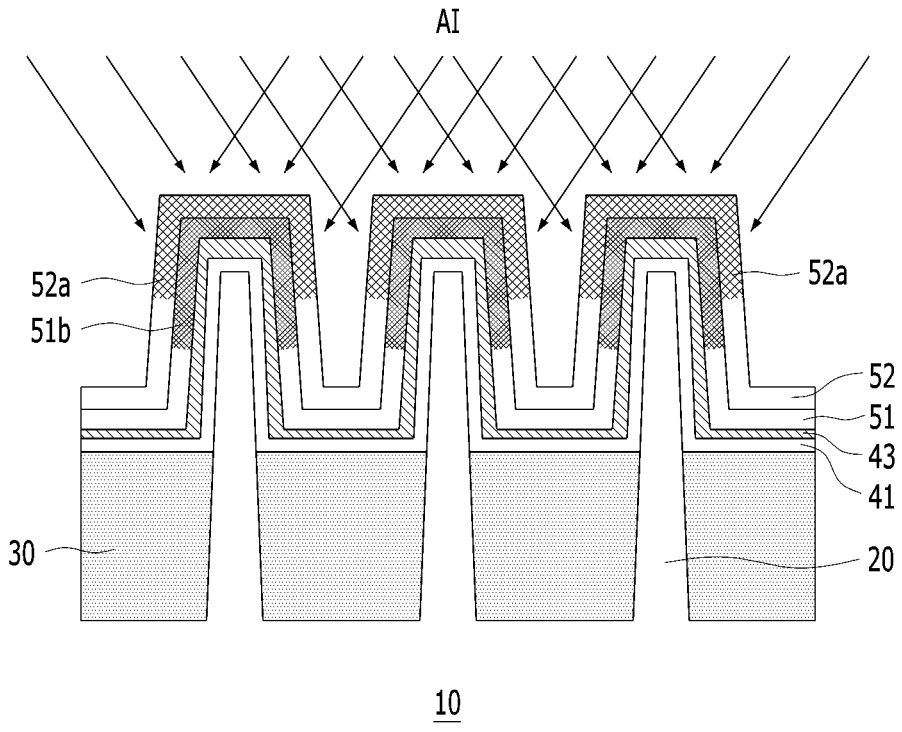

Referring to FIG. 9, the method may include performing a second amorphization process to partially form second amorphization regions 52*a* in the second lower gate electrode material layer 52. The second amorphization process may include partially amorphizing some portions of the second lower gate electrode material layer 52 by implanting amorphous ions AI into some portions of the second lower gate electrode material layer 52 at an angle with respect to the surface of the substrate 10. Accordingly, upper portions and upper portions of side portions of the second lower gate electrode material layer 52 may be amorphized to form a second amorphization region 52*a*. The amorphization ions AI may not be implanted into lower portions of the first lower gate electrode material layer 52 due to a shadow effect.

The second lower gate electrode material layer 52 may be amorphized by the second amorphization process, and a work function of the second lower gate electrode material layer 52 can be adjusted. In addition, a conductivity of the second lower gate electrode material layer 52 can be adjusted. The second amorphization process may also include a second right diagonal amorphization process and a second left diagonal amorphization process that are successively performed. In an embodiment, the second amorphization process may include performing a rotational diagonal amorphization process.

Figure 10:
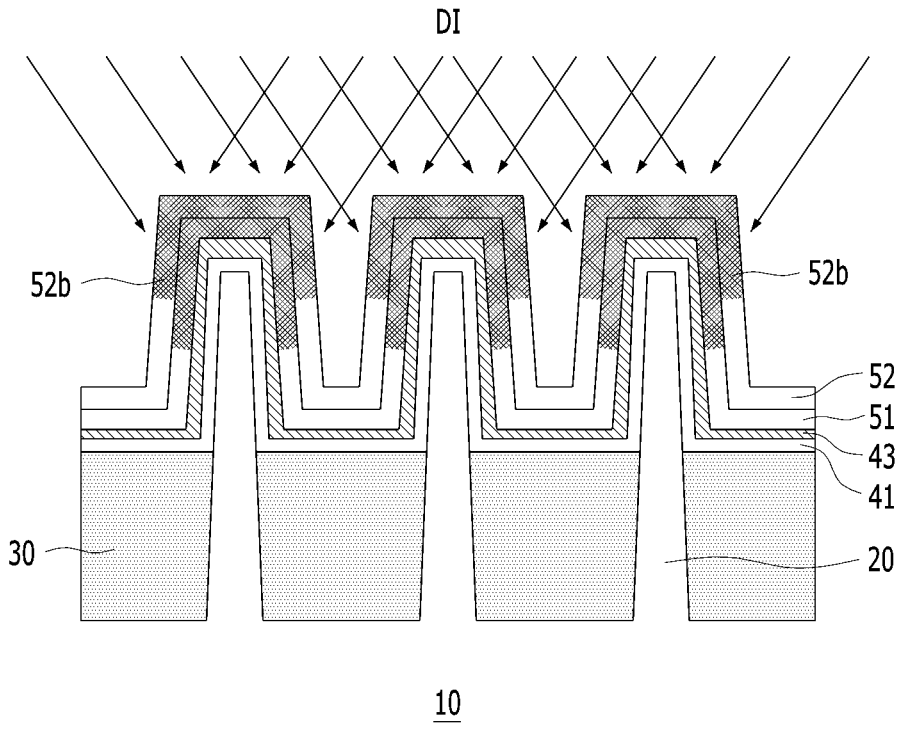

Referring to FIG. 10, the method may include performing a second dopant implantation process to form second doped regions 52*b* in the second lower gate electrode material layer 52. The second dopant implantation process may include implanting dopant ions DI into the second lower gate electrode material layer 52 at an angle with respect to the surface of the substrate 10 to form the second doped regions 52*b* in some portions of the lower gate electrode material layer 52, for example, the second amorphization regions 52*a*. The second doped regions 52*b* of the second lower gate electrode material layer 52 may be changed into P-type semiconductor regions or N-type semiconductor regions by the dopant ions DI. The second dopant implantation process may include a second right diagonal dopant implantation process and a second left diagonal dopant implantation process that are successively performed. In an embodiment, the second dopant implantation process may include performing a rotational diagonal dopant implantation process.

Figure 11:
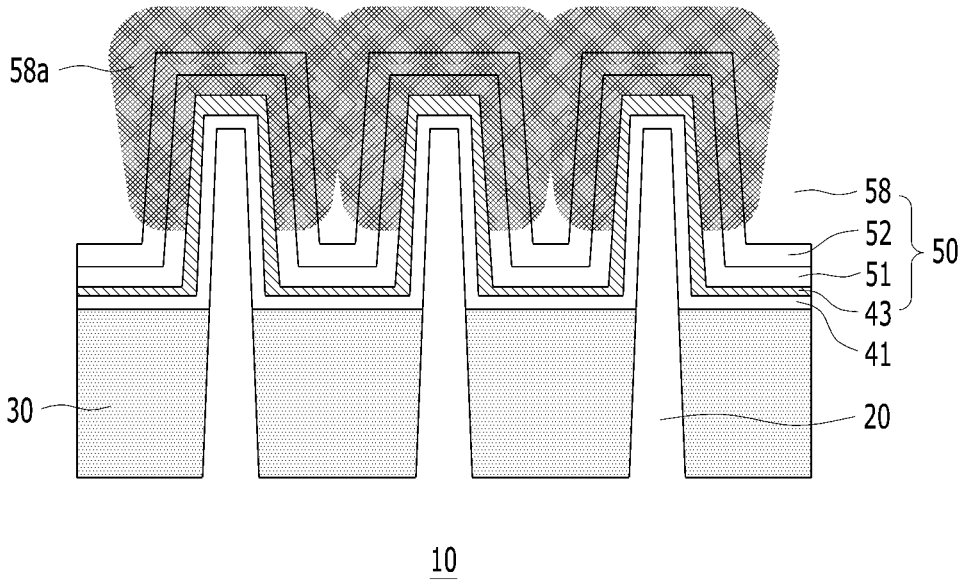

Referring to FIG. 11, the method may include forming an upper gate electrode material layer 58 and performing an ion drive-in process. The forming of the upper gate electrode material layer 58 may include performing one of an atomic layer deposition (ALD) process, a chemical vapor deposition (CVD) process, or a conformal physical vapor deposition (CPVD) process. The upper gate electrode material layer 58 may include, for example, polycrystalline silicon or amorphous silicon. The ion drive-in process may include a thermal treatment process such as annealing. During the ion drive-in process, the implanted ions AI and DI may diffuse in the gate electrode material layers 51, 52, and 58. Accordingly, ion diffusion regions 58*a* may be formed in the gate electrode material layers 51, 52, and 58. The ion diffusion regions 58*a* may include a relatively higher concentration of impurities than the other regions in the gate electrode material layers 51, 52, and 58. The other regions except the ion diffusion regions 58*a* of the gate electrode material layers 51, 52, and 58 may contain a relatively lower concentration of impurities than the ion diffusion regions 58*a*. The ion diffusion regions 58*a* may correspond to the high concentration impurity regions 56 of FIGS. 2A to 2C and 3A to 3D.

The ion diffusion can be slower in an amorphous material than in a crystallized material. In the present embodiment, since the first gate electrode material layer 51 and the second gate electrode material layer 52 are amorphized by the first and second amorphization processes, diffusion of the dopant ions DI can be slowed. Accordingly, the gate electrode 50 may have the ion diffusion regions 58*a*, that is, the high concentration impurity regions 56 and the low concentration impurity regions 55. If the first and second amorphization processes were omitted, ions would have diffused to have a similar concentration distribution in the gate electrode 50 as a whole. In the present embodiment, since diffusion of ions can be controlled using the amorphization processes, the ion concentration profile in the gate electrode 50 can be controlled.

Thereafter, the method may include selectively performing additional an etching process, a planarization process, or an ion implantation process to form the FinFET 100 illustrated in FIGS. 1A to 2C. In the gate electrode etching process for forming the FinFET 100 illustrated in FIGS. 1A and 1B, the ion diffusion regions 58*a* may lower an etch rate. Accordingly, the sidewall profile of the gate structure G may be vertical.

Figure 12:
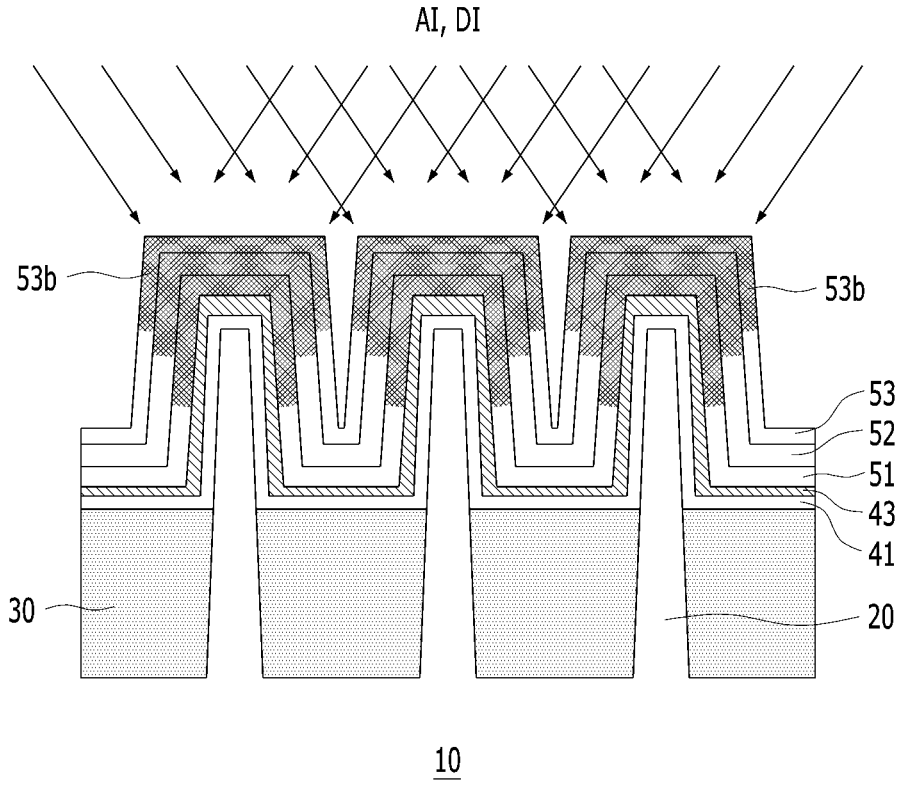

FIG. 12 illustrates a method of forming a FinFET of a semiconductor device according to an embodiment of the present disclosure. Referring to FIG. 12, a method of forming a FinFET of a semiconductor device according to an embodiment of the present disclosure may include performing the processes described with reference to FIGS. 4 to 10, forming a third lower gate material layer 53 on the second lower gate electrode material layer 52, and performing a third amorphization process and a third dopant implantation process. The third lower gate electrode material layer 53 may have third amorphization regions 53 and third doped regions 53*b*. Thereafter, the method may include performing the process described with reference to FIG. 11 to form the upper gate electrode material layer 52 and performing an ion drive-in process. In the disclosure, at least three lower gate dielectric layers 51 to 53 may be formed. In addition, plural amorphization processes and plural dopant implantation processes may be further performed. Accordingly, the amorphous regions 51*a*-52*a* and the doped regions 51*b*-53*b* may be formed in the multi-layered lower gate electrode material layers 51-53, respectively.

Figure 13:
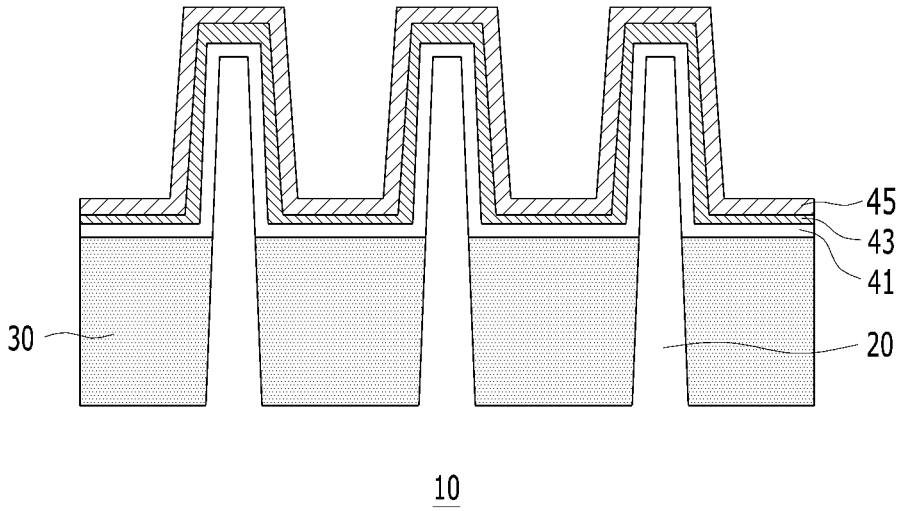

FIG. 13 illustrates a method of forming a FinFET of a semiconductor device according to an embodiment of the present disclosure. Referring to FIG. 13, a method of forming a FinFET of a semiconductor device according to an embodiment of the present disclosure may include performing the processes described with reference to FIGS. 4 and 5 to form fin-type active regions 20, a field insulating layer 30, an interfacial insulating layer 41, a gate dielectric layer 43, and a barrier layer 45 on a substrate 10. The barrier layer 45 may be conformally formed on the gate dielectric layer 43 by performing an atomic layer deposition (ALD) process or a chemical vapor deposition (CVD) process. The barrier layer 45 may include titanium nitride (TiN) or tantalum nitride (TaN). Thereafter, the processes described with reference to FIGS. 5 to 12 may be performed.

Figure 14:
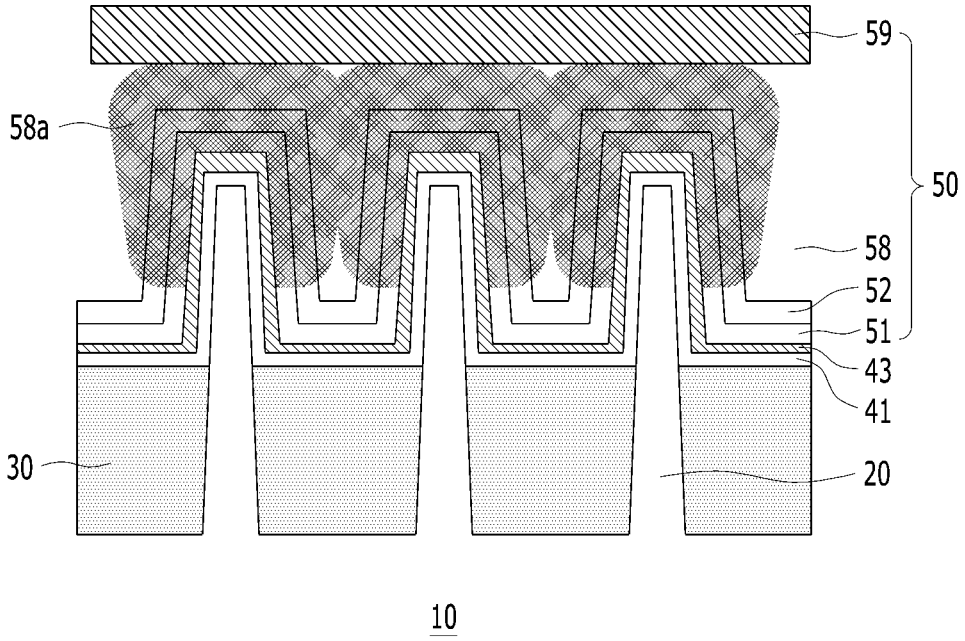

FIG. 14 illustrates a method of forming a FinFET of a semiconductor device according to an embodiment of the present disclosure. Referring to FIG. 14, a method of forming a FinFET of a semiconductor device according to an embodiment of the present disclosure may include performing the processes described with reference to FIGS. 4 to 11 and forming a silicide layer 59 on the upper gate electrode material layer 53. The silicide layer 59 may include tungsten silicide (WSi), titanium silicide (TiSi), tantalum silicide (TaSi), nickel silicide (NiSi), cobalt silicide (CoSi), or one of the other metal silicides.

Although not specifically described, it will be understood that the technical features described with reference to the present specification and the accompanying drawings can be combined in various ways.

According to the embodiments of the present disclosure, the etch rate of the gate electrode may be adjusted by implantation of impurities. Accordingly, the sidewall profile of the gate structure can be vertical.

According to the embodiments of the present disclosure, the electric field concentrated on the upper portion of the fin-type active region may be relieved by amorphization ions located close to the upper portion of the fin-type active region.

According to embodiments of the present disclosure, the work function of the gate electrode may be adjusted by amorphization ions located close to the top of the fin-type active region.

According to embodiments of the present disclosure, the threshold voltage of the FinFET may be adjusted by amorphization ions located close to the upper portion of the fin-type active region.

According to embodiments of the present disclosure, the gate dielectric layer disposed on the upper portion of the fin-type active region may be polarized by amorphization ions located close to the upper portion of the fin-type active region.

Although the technical features of the present disclosure have been shown and described with reference to specific embodiments thereof, it should be noted that the present disclosure is not limited to the embodiments described herein. Also, it will be appreciated by one of ordinary skill in the art that various changes and modifications may be made thereto without departing from the scope of the disclosure.

What is claimed is:

1. A FinFET comprising:

fin-type active regions protruding from a substrate, the fin-type active regions extending in a first direction;

a field insulating layer on a surface of the substrate between the fin-type active regions; and gate structures disposed on surfaces of the fin-type active regions and a surface of the field insulating layer, the gate structures extending in a second direction perpendicular to the first direction, wherein each of the gate structures includes a gate dielectric layer conformally disposed on the surfaces of the fin-type active regions and a gate electrode on the gate dielectric layer, wherein the gate electrode includes:

low concentration impurity regions close to the field insulating layer; and high concentration impurity regions close to an upper portion of the fin-type active regions, wherein the gate electrode further comprises middle concentration impurity regions between the high concentration impurity regions and the low concentration impurity regions.

2. The FinFET of claim 1, wherein each of the high concentration impurity regions includes an upper portion having a wide width and a lower portion having a narrow width.

3. The FinFET of claim 1, wherein each of the high concentration impurity regions includes amorphization ions and dopant ions, and wherein regions including the dopant ions are wider than regions including the amorphization ions.

4. The FinFET of claim 3, wherein the amorphization ions include at least one of nitrogen, germanium, carbon, argon, xenon, fluorine, lanthanum, and aluminum.

5. The FinFET of claim 3, wherein the dopant ions include at least one of boron, phosphorous, and arsenic.

6. The FinFET of claim 1, wherein the high concentration impurity regions are connected with each other.

7. The FinFET of claim 1, wherein the high concentration impurity regions are spaced apart from each other and the middle concentration impurity regions are connected to each other.

8. The FinFET of claim 1, wherein each of the gate structures further includes an interfacial insulating layer between the fin-type active regions and the gate dielectric layer.

9. The FinFET of claim 8, wherein the interfacial insulating layer includes silicon oxide.

10. The FinFET of claim 1, wherein the gate dielectric layer includes metal oxide.

11. The FinFET of claim 1, wherein each of the gate structures includes a barrier layer between the gate dielectric layer and the gate electrode.

12. The FinFET of claim 1, wherein each of the gate structures further includes a silicide layer over the high concentration impurity regions.

13. A FinFET comprising:

fin-type active regions protruding from a surface of a substrate, the fin-type active regions extending in a first direction;

a field insulating layer on the surface of the substrate between the fin-type active regions; and gate structures disposed on surfaces of the fin-type active regions and a surface of the field insulating layer, the gate structures extending in a second direction perpendicular to the first direction, wherein:

each of the gate structures includes a gate dielectric layer conformally disposed on the surfaces of the fin-type active regions and a gate electrode on the gate dielectric layer, the gate electrode includes amorphization ions and dopant ions, and the amorphization ions and the dopant ions have a concentration profiles gradually decreasing from upper portions of the fin-type active regions in a radial direction.

14. The FinFET of claim 13, wherein the amorphization ions include at least one of nitrogen, germanium, carbon, argon, xenon, fluorine, lanthanum, and aluminum.

15. The FinFET of claim 13, wherein the dopant ions include at least one of boron, phosphorous, and arsenic.

16. The FinFET of claim 13, wherein a concentration of the dopant ions is lowered as close to the field insulating layer.

17. A semiconductor device comprising:

a plurality of active regions each extending in a first direction, the plurality of active regions being spaced apart from each other along a second direction and extending vertically above a substrate in a third direction;

a field insulating layer disposed on a surface of the substrate between the active regions and surrounding side surfaces of lower portions of the active regions, and a plurality of gate structures disposed on a surface of the active regions and extending in parallel with each other in the second direction, wherein the gate structures include a low concentration impurity region closer to the field insulating layer and a high concentration impurity region closer to an upper portion of the active regions, and a middle concentration impurity region between the first and second impurity regions.

* * * * *